United States Patent [19]

Anderson

[11] 3,936,113

[45] Feb. 3, 1976

[54] OVERSIZE DOCUMENT STORAGE CABINET

[76] Inventor: Paul R. Anderson, P.O. Box 3584, Sarasota, Fla. 33578

[22] Filed: May 19, 1975

[21] Appl. No.: 578,427

Related U.S. Application Data

[63] Continuation-in-part of Ser. No. 434,122, Jan. 17, 1974.

[52] U.S. Cl. ..... 312/297; 312/270; 312/231

[51] Int. Cl.[2] ..... E06B 9/14; A47B 51/00

[58] Field of Search ..... 312/297, 231, 270, 260, 312/213, 3

[56] References Cited

UNITED STATES PATENTS

| | | | |
|---|---|---|---|
| 651,554 | 6/1900 | Norcross | 312/297 |
| 1,038,332 | 9/1912 | Fanning | 312/297 |
| 1,740,888 | 12/1929 | Davidson | 312/297 |
| 1,800,847 | 4/1931 | Schwarz | 312/297 |
| 2,215,158 | 9/1940 | Rickard | 312/297 |

*Primary Examiner*—Casmir A. Nunberg
*Assistant Examiner*—Victor N. Sakran
*Attorney, Agent, or Firm*—McDougall, Hersh & Scott

[57] ABSTRACT

A cabinet for storing oversized documents such as blueprints is disclosed. The cabinet includes a drawer formed of flexible material which is movable between a closed position in which it curls over on itself to form a protective cover about the documents and an open position in which it extends linearly outwardly from the cabinet to permit access to the documents.

12 Claims, 8 Drawing Figures

OVERSIZE DOCUMENT STORAGE CABINET

CROSS REFERENCE TO RELATED APPLICATION

This application is a continuation-in-part of application Ser. No. 434,122 filed Jan. 17, 1974.

BACKGROUND OF THE INVENTION

The present invention relates to the field of document storage such as file cabinets and the like. More specifically, it relates to cabinets for storing oversize documents such as blueprints, maps, charts and the like. A particular problem in storing such oversize documents is the desirability of not creasing or folding them as this tends to decrease their useful life. For example, once folded, blueprints tend to become more difficult to read and often experience tearing during the folding and unfolding process. Furthermore, when oversize documents are folded for storage, it is difficult to quickly identify a desired document among a group of many.

It is accordingly an object of the present invention to provide a document storage cabinet which opens to a position where the stored documents may be quickly and easily reviewed to obtain a desired document.

It is another object of the invention to provide a document storage cabinet which has a drawer which forms a protective cover about the documents when they are stored therein.

It is yet another object of the present invention to provide a document storage cabinet which employs a movable cantilevered drawer.

Other objects of the present invention will become apparent from the remaining portion of the specification.

DETAILED DESCRIPTION

Figure 1:
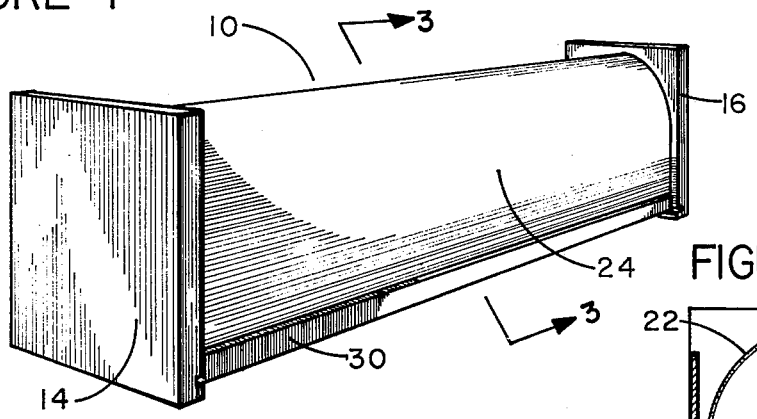
FIG. 1 is a perspective view of a document cabinet according to a first embodiment in its closed position.
Figure 3:
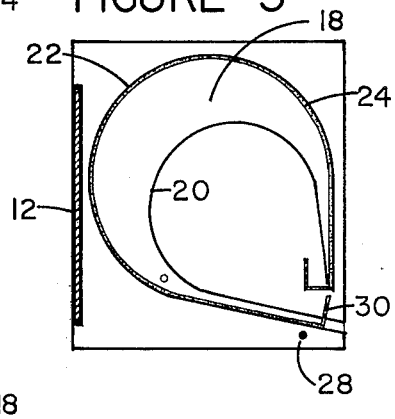
FIG. 3 is a cross-sectional view along the lines 3—3 of FIG. 1.
Figure 2:
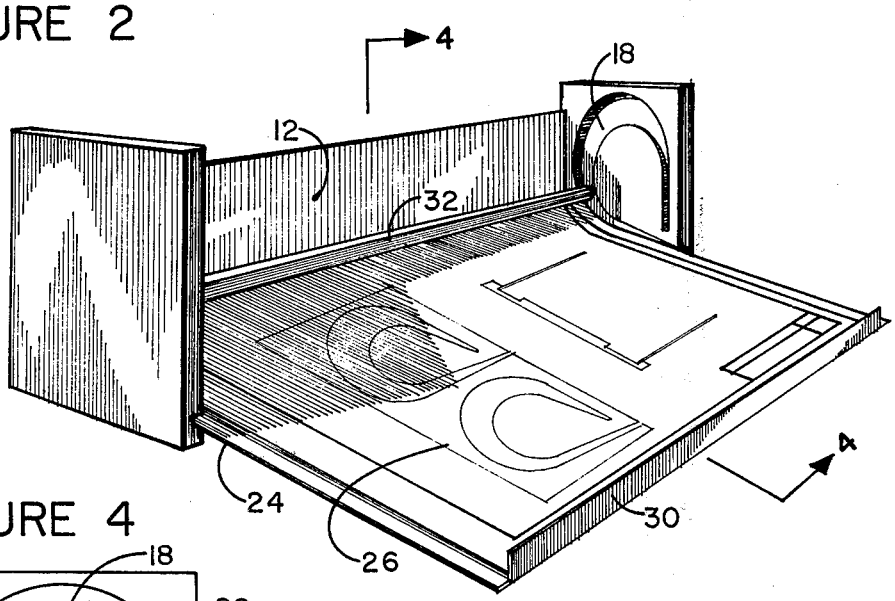
FIG. 2 is a perspective view of the first embodiment in its open position showing the flexible drawer extended with a document supported thereon.

Referring to FIGS. 1 and 2, a cabinet 10 for storing oversized documents is shown. The cabinet includes a cabinet back 12 and cabinet ends 14 and 16 joined thereto. The cabinet back is adapted to be mounted on a wall at a suitable height. As shown in FIG. 3, there is a recessed guide channel 18 formed in each of the cabinet ends 14 and 16. The guide channel has an inner diameter 20 and an outer diameter 22.

Figure 4:
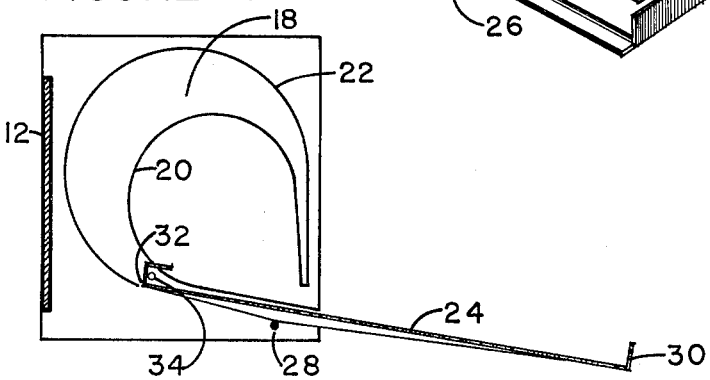
FIG. 4 is a cross-sectional view along the lines 4—4 of FIG. 2.
Figure 5:
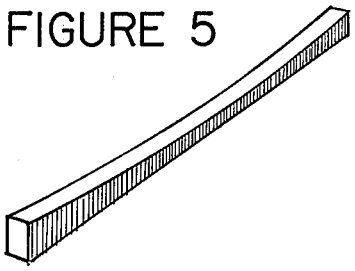
FIG. 5 is a view of an alternate rigid support for the drawer.

A drawer 24 formed of flexible material is adapted to track in the guide channel 18. The drawer may be formed of any flexible material of suitable strength, however, materials such as polystyrene or acrylonitrile-butadiene-styrene are preferred. Use of such material permits the drawer to be curled about itself as shown in FIGS. 1 and 3 to form a protective cover around an oversize document 26 placed thereon. When the drawer is opened, however, it does not drop downwardly but, as shown in FIGS. 2 and 4, extends linearly outwardly from the cabinet supported on a drawer support 28. The drawer support 28 is preferably resilient comprising an elastic rope or cord which runs the entire length of the cabinet and is fastened to each of the cabinet ends 14 and 16. The drawer support is adjusted so that when the drawer rests thereon in the open position, the central portion of the drawer sags with respect to the ends of the drawer. Supporting the drawer in this manner causes the drawer to extend linearly as shown in FIGS. 2 and 4. Alternately, the drawer support may be a rigid support having a preformed contour as shown in FIG. 5.

Initially, a flexible drawer support must be adjusted to produce the correct amount of sag in the drawer. Too much tension on the drawer support provides too little sag for the drawer and the extended end of the drawer will bend downwardly making it difficult to remove documents therefrom. Too little tension, i.e., too much sag for the drawer, will permit the ends of the drawer to slip out of the guide track. If properly positioned during assembly, the drawer support should not require further adjustment. The rigid support, of course, does not require such initial adjustment.

Provided on either end of the drawer 24 is an outer document retainer and handle 30 and an inner document retainer 32. The handle 30 is utilized to pull the drawer open and further serves to keep the documents 26 from sliding off the drawer in the open position. The inner document retainer 32 prevents the documents from curling at a smaller radius than the drawer. The drawer stop 34 limits the outward travel of the drawer and preferably is disengageable to permit complete drawer removal.

As will be apparent from the foregoing, oversized documents are placed on the flexible drawer when it is in the extended position shown in FIGS. 2 and 4. For storage the drawer is pushed toward the cabinet. It follows outer radius 22 of the guide tracks 18 and is caused to curl back on itself as shown in FIGS. 1 and 3. In the latter position the documents are similarly curled inside the drawer for safe storage.

The cabinet thus voids the usual problems associated with storage of oversize documents. No folding is necessary and no special filing system is required. When it is desired to remove a document stored in the cabinet, the drawer is opened by grasping the handle 30 and pulling. The drawer uncurls following the guide tracks and cantilevers out to the linearly extended position. In the extended position, the drawer rests on either a flexible or rigid contoured drawer support which permits the drawer to sag in its center portion to cantilever the drawer linearly outwardly from the cabinet. In this extended position, a desired document can be removed from the drawer simply by lifting it free of the retainer 30.

The guide tracks 18 are shaped so as to minimize friction on the drawer during opening and closing. During opening and closing the drawer will be in contact with the outer radius 22. The inner radius 20 is provided to prevent the drawer from curling too tightly during opening and damaging itself or the documents stored therein.

Figure 6:
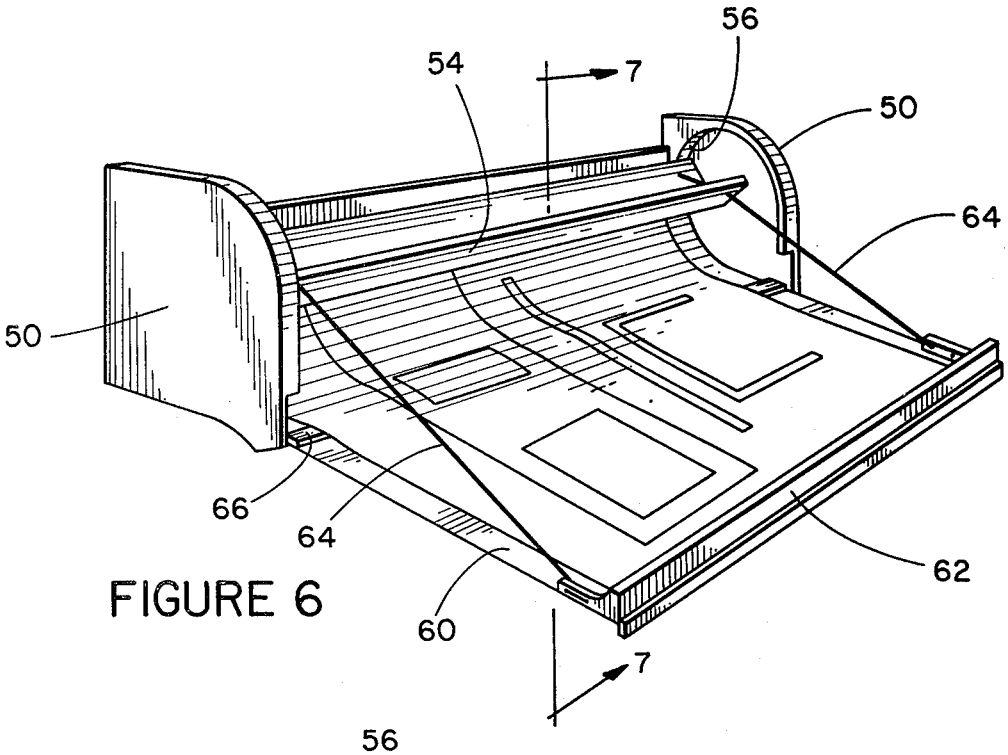
FIG. 6 is a perspective view of a cabinet according to a second embodiment.
Figure 7:
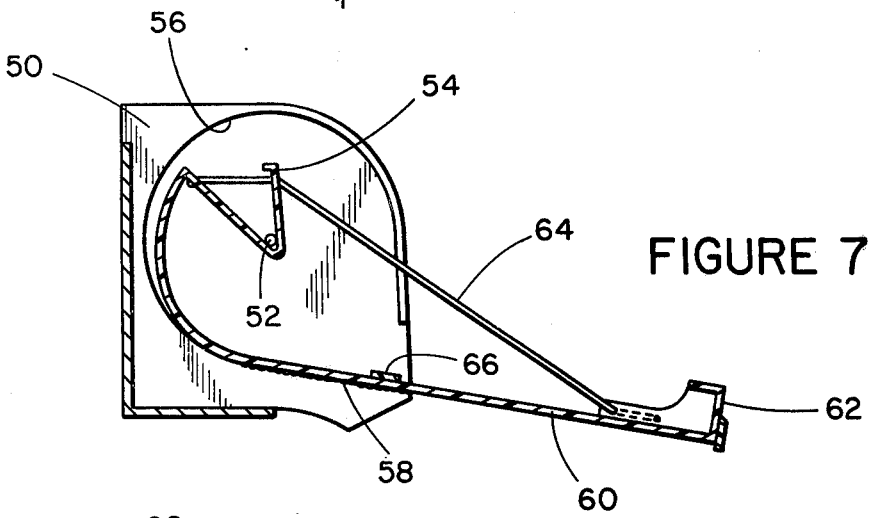
FIGS. 7 and 8 are cross-sectional views of the cabinet according to the second embodiment.
Figure 8:
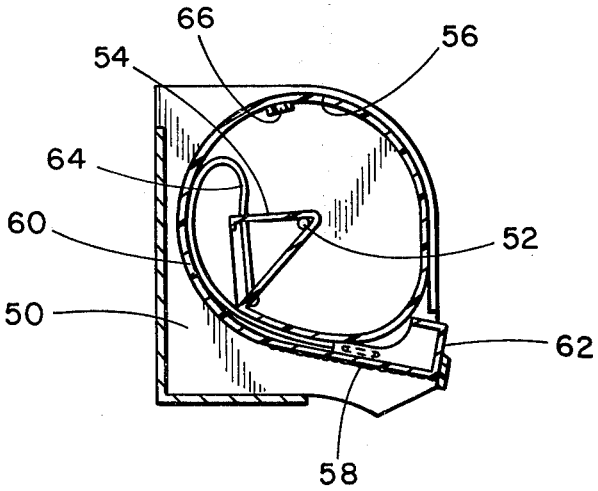

Referring now to FIGS. 6–8, a second and preferred embodiment of the invention is illustrated. Cabinet ends 50 have a pivot pin 52 extending inwardly, adapted to receive a rigid end guide 54 which may be described as having a V-shaped configuration. Recessed into the cabinet ends 50 is a single outer guide channel 56 which is serrated along a bottom portion 58 thereof. A flexible drawer 60 has attached to one end an end guide 54 while a drawer pull 62 is provided at the other end of the drawer.

Connecting the end guide 54 to the drawer pull 62 are tensioning members 64 located on the sides of the drawer. The tensioning members 64 are attached to the drawer pull 62 at both sides of the drawer 60. The purpose of the tensioning members is to support the drawer in the extended position indicated in FIG. 7 and to help adapt flat drawer 60 to its curved shape. The tensioning members further provide a positive stop when the drawer is opened. By adjusting the length of the tensioning member 64, the position of the drawer when extended can be adjusted higher or lower as desired by the user.

Provided on and movable with the drawer 60 is a drawer support or rib 66. The rib is physically attached to either the inside or the outside of the drawer, but as illustrated, it is preferably located on the inside. The incorporation of the rib on the inside eliminates the friction which is inherent in the first embodiment requiring the drawer to slide over the support. The support controls the amount of drawer deflection or sag.

As mentioned, the inner guide channel is omitted in this embodiment while the outer guide channel is serrated along a portion 58 thereof. The inner guide channel is not required in the present embodiment due to the use of the end guide 54 in combination with the tensioning members 64. Serration of the outer guide track along its bottom portion reduces the surface area of the drawer which frictionally engages during movement of the drawer between its open and closed positions. Thus, friction is reduced while maintaining adequate tracking.

Considering now the operation of the second embodiment, it will be apparent that the drawer 60 is movable between the closed position indicated in FIG. 8 where the drawer rolls back over itself and an open position (FIG. 7) wherein the drawer 60 extends outwardly from the cabinet end for providing access to the drawings. In order to open the drawer from the closed position, the drawer pull 62 is grasped by the user and the drawer is pulled outwardly until the tensioning members 64 reach their full travel which prevent further withdrawal of the drawer, such tensioning members serving to also support the drawer in the open position at a desired vertical level. In the closed position, the end guide 54 is supported on the pivot pins 52, while in the open position the end guide is maintained near the pivot pin due to the support of the lower portion of the guide track and the natural resiliency of the drawer.

The portion of the end guide 54 which connects the pivot pin 52 with the leading edge of the drawer 60 is so established as to maintain the drawer 60 at a radius which is less than the radius of the cabinet end 50. This allows the drawer to roll back over itself as indicated in FIG. 8, while further serving to reduce friction during movement of the drawer.

While I have shown and described embodiments of this invention in some detail, it will be understood that this description and illustrations are offered merely by way of example, and that the invention is to be limited in scope only by the appended claims.

I claim:

1. A cabinet for storing oversize documents without folding, comprising:

a cabinet frame including a back mounting and a pair of cabinet ends having guide channels formed therein;

a flexible drawer mounted on said frame movable in said channels between a curled position storing said documents in a loosely curled state and an open position extending outwardly from the cabinet supporting said documents thereon in a flat state for easy viewing and selection;

inner document retaining means on said drawer for maintaining said documents in said loosely curled state in said closed position; and outer document retaining means for retaining said documents on said drawer in said open position.

2. The cabinet according to claim 1 wherein said outer document retaining means is a raised structural element which also functions as a handle to permit manual movement of said drawer between said open and closed positions.

3. The cabinet according to claim 1 wherein said guide channels are wider at their mid portion than at their ends whereby during opening, the outer edges of the channels guide the drawer while on closing the inner edges of said channels prevent the drawer from curling excessively.

4. The cabinet according to claim 1 wherein said drawer in the open position is supported on a drawer support and cantilevers out to an extended position beyond the frame to permit access to the stored documents.

5. The cabinet according to claim 1 wherein said drawer in the closed curled position forms a protective cover about the documents.

6. The cabinet according to claim 4 wherein said drawer support is flexible and comprises a resilient cord positioned beneath said drawer and attached to said cabinet ends, said cord supporting said drawer in the open position in a manner so as to permit the center of the drawer to sag, thereby to produce the cantilever action which extends the drawer linearly outwardly from the cabinet.

7. The cabinet according to claim 4 wherein said drawer support is rigid and comprises a contoured member positioned beneath said drawer and attached to said cabinet ends, said member supporting said drawer in the open position in a manner so as to permit the center of the drawer to sag, thereby to produce the cantilever action which extends the drawer linearly outwardly from the cabinet.

8. A cabinet for storing and displaying oversize documents, comprising:

a. a back mounting for attachment to a wall;

b. a pair of cabinet ends attached to said back mounting each end having a guide channel formed therein and a pivot pin extending therefrom; and c. a flexible drawer having an end guide attached to one end and a drawer pull attached to the other end, said drawer supported on said pivot pins and movable between a cantilevered display position and a curled storage position protecting said documents.

9. A cabinet according to claim 8 wherein said cabinet further includes flexible tensioning means connecting said end guide to said drawer pull to limit the extension of said drawer and to support said drawer in the display position.

10. A cabinet according to claim 8 wherein said guide channel is serrated along a lower portion thereof to reduce surface friction during movement of said drawer between said storage and display positions.

11. A cabinet according to claim 8 further including a drawer support attached to said drawer and extending transversely thereon to limit drawer sag in the display position.

12. A cabinet according to claim 8 wherein said end guide is V-shaped and engages said pivot pins to support said drawer thereon.

* * * * *